United States Patent [19]

Miyamoto

[11] Patent Number: 4,513,269

[45] Date of Patent: Apr. 23, 1985

[54] INTERLOCKING CONTACTOR ASSEMBLY

[76] Inventor: Motomu Miyamoto, 108 House Toritsudai, 12-21, 2-Chome, Nakane, Meguro-Ku, Tokyo, Japan

[21] Appl. No.: 500,148

[22] Filed: Jun. 1, 1983

[30] Foreign Application Priority Data

Jun. 3, 1982 [GB] United Kingdom ..... 57-95632

[51] Int. Cl.[3] ..... H01H 9/20

[52] U.S. Cl. ..... 335/161; 335/160; 335/132; 200/1 V

[58] Field of Search ..... 335/159, 160, 161; 200/1 V, 6 B; 361/77, 127

[56] References Cited

U.S. PATENT DOCUMENTS

| | | | |
|---|---|---|---|
| 2,446,299 | 8/1948 | Nelson | 335/160 |
| 2,606,260 | 8/1952 | Frese | 335/160 |
| 3,936,782 | 2/1976 | Moakler et al. | 335/161 |

*Primary Examiner*—E. A. Goldberg
*Assistant Examiner*—George Andrews
*Attorney, Agent, or Firm*—Fred Philpitt

[57] ABSTRACT

A contactor assembly is disclosed comprising a case having a plurality of serially and vertically sectioned pole chambers, each provided with a traveling contact and a pair of operation frames. A traveling contact bar having right and left arm portion is pivotally fixed on a support frame. The operation frames are installed at right and left positions of the traveling contact, and each frame is provided with a window and a leg portion extending from a lower surface of the frame. A pair of upper and lower contact springs are provided in the window, and the adjacent arm portion of the traveling contact extends through the window and is sandwiched by the pair of contact springs. The pair of right and left operation frames are interlockingly connected at the lower ends of both the legs. An electromagnet is connected to each leg and a return spring is provided on the lower surface of the frame. At least one traveling contact terminal is provided at each tip of the arm portions of the traveling contact bar, and a stationary contact terminal is provided in the path of the traveling contact terminals. At least one connecting terminal is provided at each side of the pole chamber.

13 Claims, 15 Drawing Figures

INTERLOCKING CONTACTOR ASSEMBLY

BACKGROUND OF THE INVENTION

This invention relates to integral unit contactor assemblies for reversible change-over and Y-Δ or change-over for various modes and is composed of a case member, a traveling contact mechanism of metal proper installed in the case proper, a stationary contact, and terminals consisting of various terminal bars for electrical connection to the reverse surface of the case proper by wirings, whereby the traveling contact mechanism and each terminal are used in common for regular and reversal rotations according to the change-over of the stationary contacts, or are used in common for Y and Δ.

Heretofore, various contactors have been available which correspond to change-over modes comprising mere making and breaking of circuit, change-over of circuit, and Y-Δ change-over in three phase AC. Such contactors are of one-dimensional contact and are required to be prepared for exclusive uses by combining a plurality of contactors optionally in order to obtain various change-over modes. For example, the contactors used for reversible operation against the operations of automatic doors, and valves for gas and fluid are constructed in such a way that two units of electromagnetic contactors for regular and reverse rotations were combined and circuit wirings were provided for contact construction. Therefore, wiring and mounting processes were numerous, and moreover, the wiring operations were extremely difficult in the structure of the conventional contactors. Furthermore, in the large size contactors, installation spaces became larger of and the costs were beyond original calculations, resulting in numerous drawbacks of the conventional contactors.

SUMMARY OF THE INVENTION

An object of this invention is to provide contactors assembled for reversible change-over in which traveling contacts and stationary contacts and terminals R, S, T, U, V, W and X, Y, Z are used for regular and reversal rotations in common and they are formed into an integral unit, and as a result, this invention has eliminated the various difficulties with regard to the cost load and the wirings owing to the combinations of two units of contactors for regular and reverse rotations like those of the conventional contactors.

Another object of this invention is to provide a contactor assemble for Y-Δ in which a contact mechanism and terminals R, S, T, U, V, W and X, Y, Z are provided in an integral unit for common use for Y and Δ change-over.

A still further object of this invention is to provide a compact size contactor assemble for reversible change-over or for Y-Δ by forming a contact mechanism and each terminal for primary side and secondary side for regular and reversal rotations or for Y and Δ in common.

A yet still further object of this invention resides in the adoption of a metal traveling contact mechanism. As a result, a provision of a multi-purpose contactor by arrangement of the stationary contacts is made variable, and the contact mechanism and the terminals are used in common for regular and reversible rotation or for Y and Δ so that the multi-purpose contactor is provided.

A separation object of this invention resides in that each terminal for primary side and secondary side is formed of a terminal bar for electrical connection by wiring on the reverse surface of the case, and a circuit wiring process for construction of contacts of each terminal for the primary side and the secondary side is extremely easy work.

Another separate object of this invention is to provide an electromagnetic contactor in which each terminal is selected optionally to be able to form a contact construction corresponding to regular and reversible change-over or Y-Δ or for various modes for change-over, and as a result, the wiring process is only carried out by causing the electrical connection of the terminal to correspond to various modes, and thus, the contactor for regular and reversible change-over or Y-Δ change-over and change-over for various modes can be manufactured from the identical structure.

A still separate object of this invention is to provide an electromagnetic contactor in which auxiliary contacts are integrally provided.

BRIEF DESCRIPTION OF THE DRAWINGS

The drawings relate to this invention as follows.

DETAILED DESCRIPTION OF THE INVENTION

Figure 1:
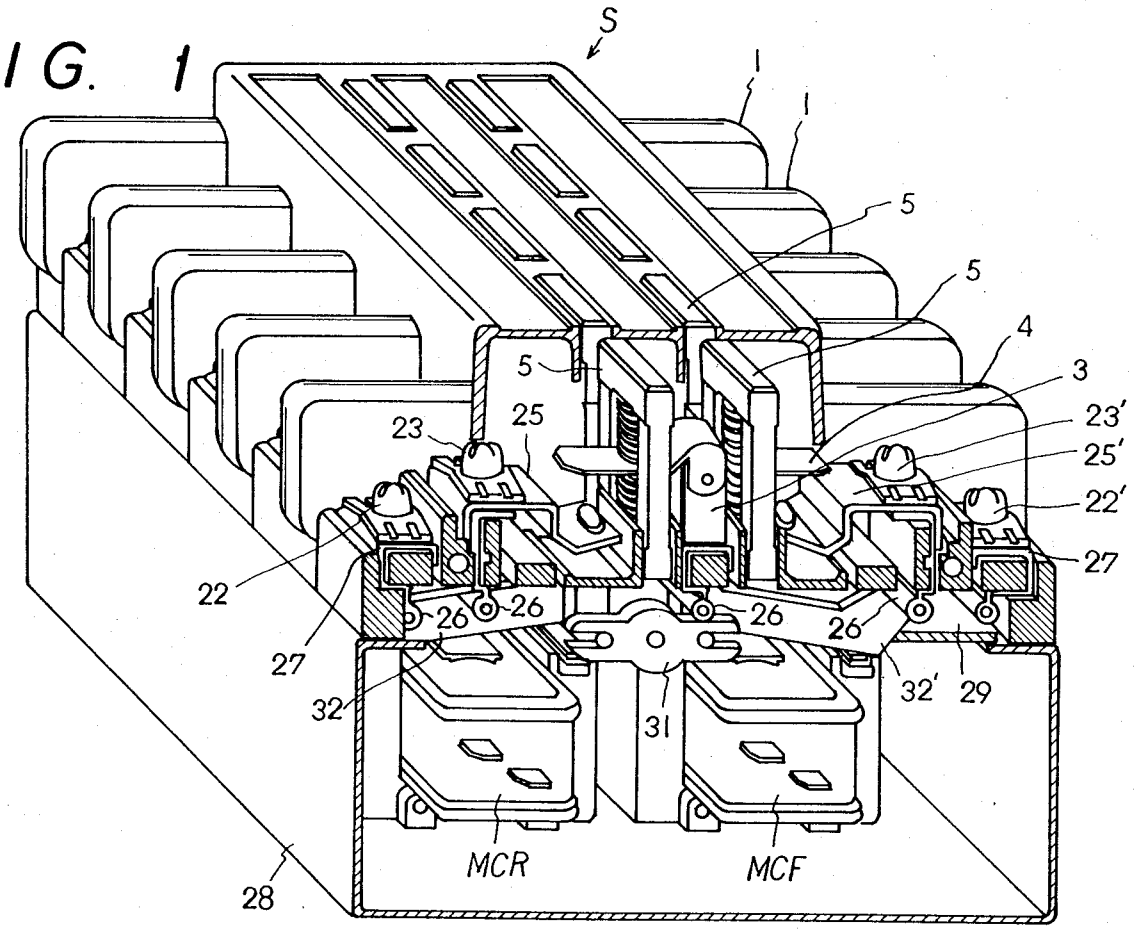
FIG. 1 is a perspective view of the reversible change-over contactor assembly in which the contact mechanism is illustrated in partial section
Figure 2:
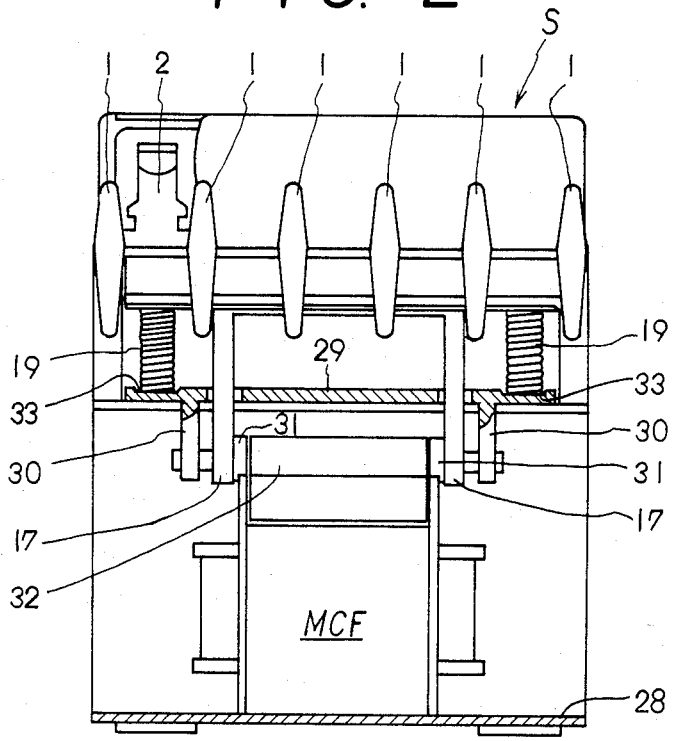
FIG. 2 is a side view showing the assembly in cross section.

FIG. 1 shows the electromagnetic contactor for the reversible change-over, and the case proper indicated by normal letter S is formed by providing pole chambers 2, 2, 2 for main contact which are vertically sectioned by a plurality of diaphragms and pole chambers 2', 2' for auxiliary contacts serially, and each pole chamber 2 and 2' for the main contact and auxiliary contact is provided with a traveling contact mechanism having swivellable traveling contacts and connecting terminals composed of terminal bars for wiring on the lower surface of the case proper S, and two pieces of electromagnetic MCF and MCR are provided for regular and reversal rotations on the lower surface of the case proper S.

Figure 3:
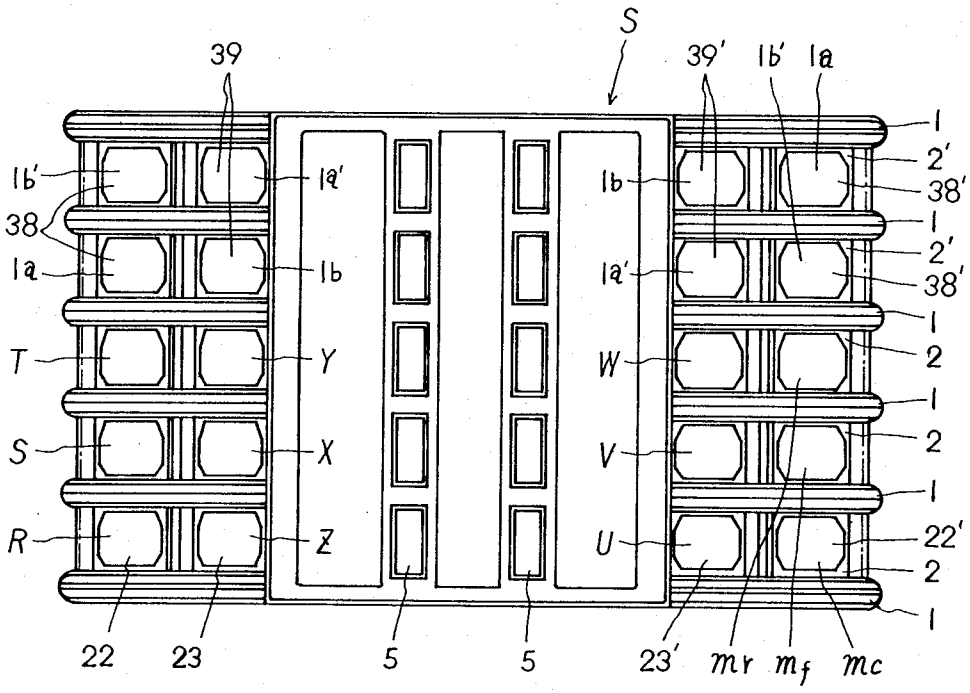
FIG. 3 is a top view of the assembly.
Figure 4:
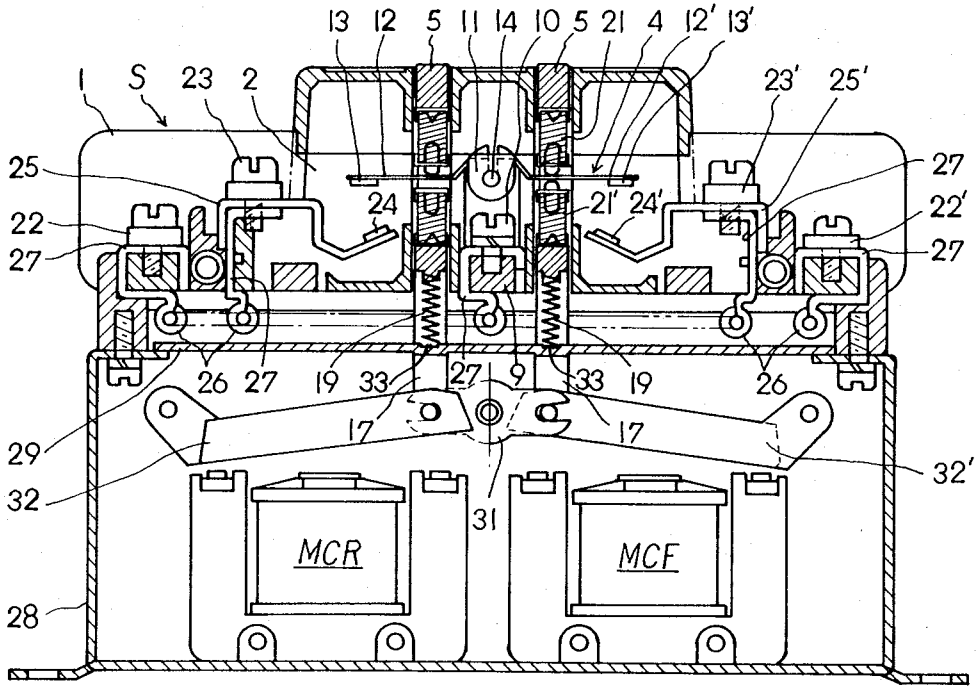
FIG. 4 is a vertical cross section showing the OFF condition of the contact construction of the main contact.
Figure 5:
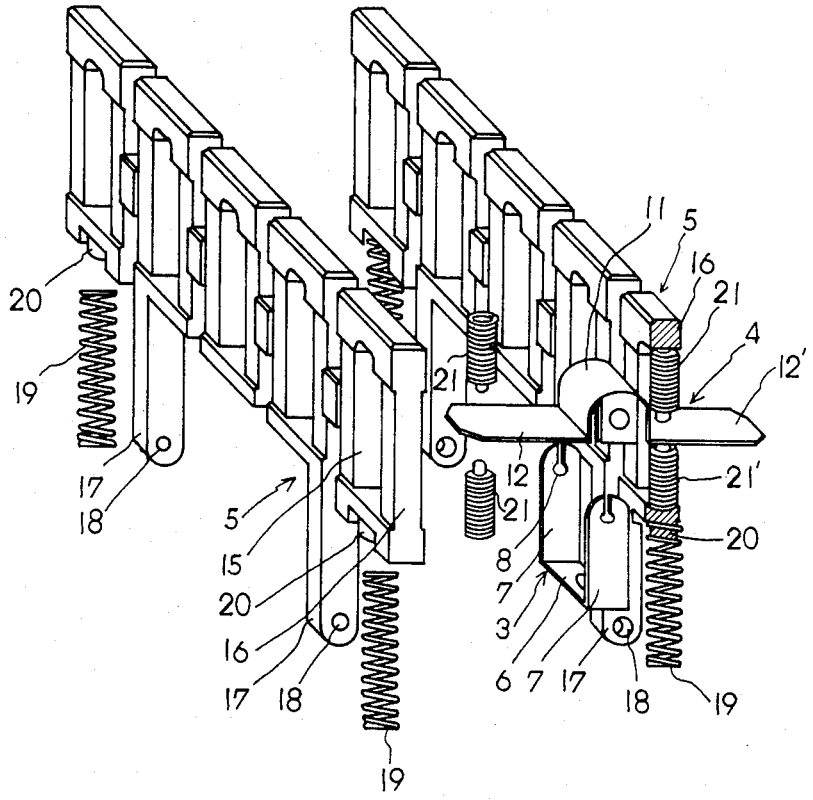
FIG. 5 is a perspective view of the disassembled traveling contact.
Figure 6:
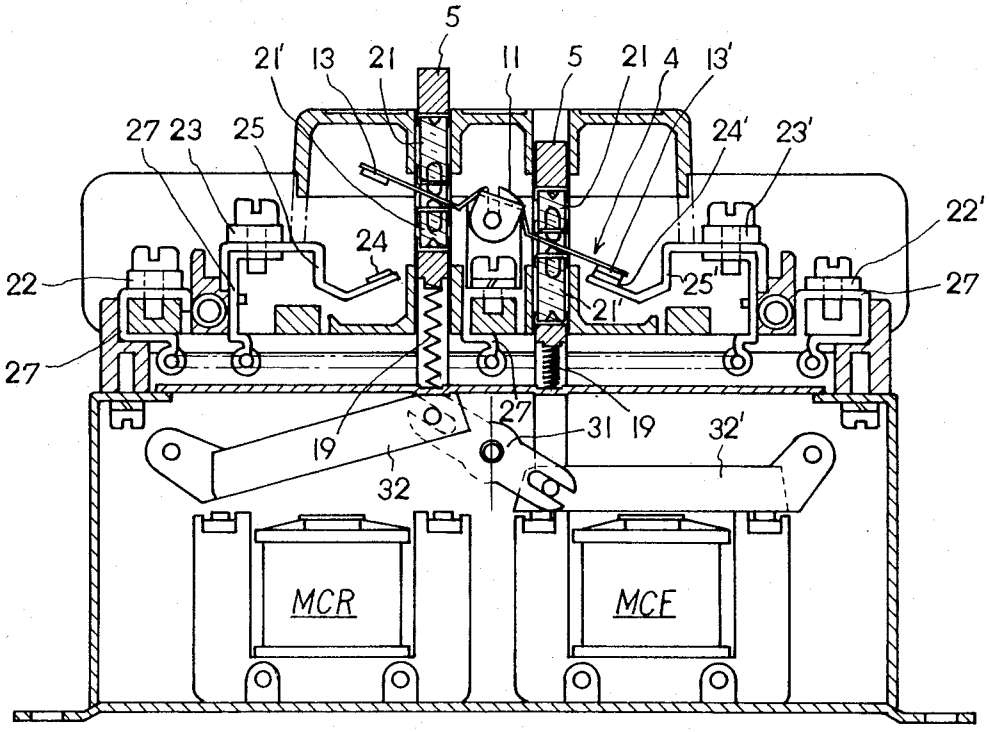
FIG. 6 is a vertical cross section showing the regular operating condition.

The traveling contact mechanism for the main contact is formed by the combination of a support frame 3 made of conducting material and a traveling contact bar 4 and a pair of operation frames 5 as shown in FIGS. 3 through 5. The support frame 3 is U-shaped and is provided with a bottom portion 6 and two sheets of vertical frame portions 7, and a bearing portion 8 formed with a vertical groove is formed on the upper end of the vertical frame portion 7. The support frame 3 is fixed to a base portion 9 at the bottom portion 6 in the center bottom portion of the case proper S by means of a screw 10. The traveling contact bar 4 is provided with a bearing portion 11 in the center portion and a pair of right and left arm portions 12 and 12' are integrally and horizontally extended. Main contact traveling terminals 13 and 13' are provided on the reverse surface of the tips of each right and left arm portion 12 and 12', and the bearing portion 11 of the traveling contact bar 4 is pivotally fixed to the bearing portion 8 of the support frame 3 by means of a shaft 14. The pair of operation frames 5 vertically and intrgrally suspend the leg frame portion 17 from the one side portion of the lower surface of the frame portion 16 having the rectangular window 15. An axial hole 18 is formed on the lower end of the leg frame portion 17, and a projecting member 20 for installing a return spring 19 is provided on the lower surface of the frame portion 16. The pair of the operation frames 5 are installed vertically slidably at both sides of the support frame 3, and the right and left arm portions 12 and 12' of the traveling contact bar 4 extend through windows 15 of the right and left operation frames 5, respectively. The main contact traveling terminals 13 and 13' are disposed at positions that run through the windows 15.

In each window 15 of the right and left operation frames 5, a pair of vertical contact springs 21 and 21' are fixed at upper ends and lower ends of the windows 15, and each arm portion 12 and 12' of the traveling contact bar 4 that run through the windows 15 is resiliently sandwiched between the free ends of the vertical contact springs 21 and 21'. These vertical pair of contact springs 21 and 21' are arranged to have the same elastic modulus and to position and retain the traveling contact bar 4 horizontally in the OFF condition.

Two pieces of the main contact terminals 22 and 23 are disposed in staggered positions at the left side of the case proper S so as to be at a lower position on the outside and an upper position on the inside, respectively and similarly, two pieces of the main conact terminals 22' and 23' are disposed in staggered positions at the right side thereof so as to be at the lower position on the outside and at the upper position on the inside.

The main contact terminals 24 and 24' are disposed at positions corresponding to the swiveling operations of the main contact traveling terminals 13 and 13' provided on the lower surfaces of the right and left ends of the traveling contact bar 4, and the main contact stationary terminal 24 is connected to the main contact terminal 23 by means of a contact bar 25, and the main contact stationary terminal 24' is connected to the main contact terminal 23' by means of a contact bar 25'.

The main contact terminals 22, 23 and 22', 23' are provided with terminal bar 27 having a wiring portion 26 projecting to the lower surface of the case S, and similarly, the support frame 3 of the traveling contact bar 4 is fixed to the base portion 9 by means of a terminal bar 27 having the wiring portion 26. The terminal bar 27 has various shapes and lengths according to the conditions of installed location, and the wiring portion 26 is arranged at a projecting position on the lower surface of the case S. A flat plate 29 is disposed over the upper surface of a mount 28 that houses the two pieces of the electromagnets MCF and MCR, and a bearing portion 30 is provided on the reverse surface of the flat plate 29. A connecting lever 31 is pivotally fixed to the the bearing portion 30 in the center portion. The axial hole 18 of the left and right leg frame portions 17 of the operation frames 5 and the traveling iron cores 32 and 32' respectively of electromagnet MCR and MCF, respectively, are coaxially pivotally fixed at both right and left ends of the connecting lever 31.

The return spring 19 is installed between the projecting member 20 provided on the lower surface of the frame portion 16 of the operation frame 5 and a depressed portion 33 provided on the mount 28.

Figure 7:
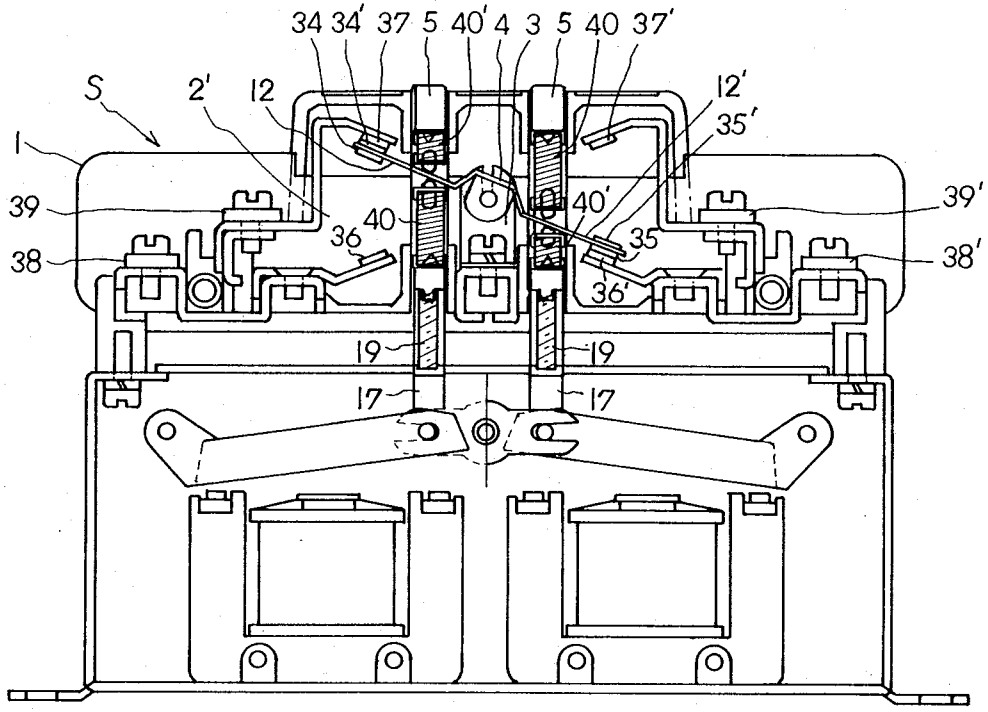
FIG. 7 is a vertical cross section showing the contact construction of the auxiliary contacts in the OFF condition.

The traveling contact mechanism for the auxiliary contact as shown in FIG. 7 is formed by assembling the support frame 3 and the traveling contact bar 4 and the pair of right and left operation frames 5 similar entirely to the traveling contact mechanism for the main contact, and the traveling contact bar 4 is swivellably operated by the lifting motion of the right and left operation frames 5.

However, the traveling contact bar 4 for the auxiliary contact is provided with auxiliary traveling contacts 34, 34', 35, 35' at 4 locations on the upper surface and lower surface of each tip of the right and left arm portions 12 and 12', and 4 pieces of auxiliary contact stationary terminals 36, 36', 37, 37' corresponding to the 4 pieces of the auxiliary contact traveling terminals 34, 34', 35, 35' are connected to locations corresponding to the swiveling operations of each auxiliary contact traveling terminals 34, 34', 35, 35' in the upper and lower parts of the right and left of the traveling contact bar 4 and are connected to auxiliary contact terminals 38, 38', 39, 39'. These auxiliary contact terminals 38, 38', 39 and 39' are disposed in staggered manner at the lower stage of the outside and the upper stage of the inside of the right and left of the case S similar to the main contact terminals 22, 22', 23, 23', wherein the stationary terminal 36 is connected to the terminal 38, the stationary terminal 37 is connected to the terminal 39, the stationary terminal 36' is connected to the terminal 38', and the stationary terminal 37' is connected to the terminal 39' respectively.

The traveling contact mechanism for the auxiliary contact is constructed in such a way that in order to form a b contact in the OFF condition, two kinds of long and short contact springs 40 and 40' whose resilient forces are identical are installed in the window 15 of the operation frame 5 as a pair and the traveling contact bar 4 is retained in an inclined mode to connect and hold the stationary contacts 36 and 37' as shown in FIG. 7. In this case, each pole chamber 2' and 2' of the regular and reversal rotations for the auxiliary contact and the respective traveling contact bars 4 and 4 are crossed orthogonally to construct the b contact whereby the wiring is conveniently formed.

The operation frame 5 is serially and integrally formed as shown in FIG. 5 without forming it for each pole chamber for the main contact and the auxiliary contact, and in this case, the leg frame portion 17 and the return spring 19 are suffice to be provided at each two locations of both ends.

The main contact terminal 22 of the pole chambers 2, 2, 2 for the main contact of the case S is set to be the terminals R, S, T, the terminal 23 is set to be the terminals Z, X, Y, the terminal 22' is set to be the U, V and W, and the terminal 22 is set to be the terminals mc, mf, mr to be connected to the electromagnets MCF and MCR for regular and reversal rotations the terminal 38 of each pole chamber 2' and 2' of the regular and reversal rotation for the auxiliary contact is set to be 1*a* or 1*b'*, the terminal 39 is set to be 1*b* or 1*a'*, the terminal 38' is set to be 1*b'* or 1*a*, and the terminal 39' is set to be 1*a'* or 1*b*. The respective main contact terminals 22, 23, 22' and 23' contact the terminals R, S, T to each traveling contact of each pole chamber 2, 2, 2 by means of the wiring portion 26 of each terminal bar 27, whereby the contact is formed by connecting the terminals U and X and the terminals V and Y and the terminals W and Z.

This invention has the foregoing construction, so that the traveling contact bar 4 of the main contact is positioned horizontally by the contact springs 21 and 21' in the OFF condition, and the main contact traveling terminals 13 and 13' and the main contact stationary terminals 24 and 24' are separated, and the traveling contact bar 4 of the auxiliary contact is caused to be inclined by the long and short contact springs 40 and 40', and is connected to the b contact.

When the electromagnet MCF for regular rotation is excited, a traveling iron core 32' is attracted and the operation frame 5 at the regular rotation side descends by resisting the spring 19, and the main traveling terminal 13 and the main contact stationary terminal 24', namely, the terminals U, V, and W are connected. Simultaneously, the auxiliary contact is such that the b contact is open and the a contact is connected. Each traveling contact bar 4 of the main contact and the auxiliary contact is constructed in such a way that the pair of the upper and lower contact springs 21 ad 21' and 40 and 40' elongate or contract and the contacting is maintained with the proper contact pressure. Since the power source terminals R, S and T are connected to the traveling contact bar, as shown in the wiring diagram of FIG. 8, R-U-X, S-V-Y and T-W-Z are connected, and the circuit for regular rotation is closed. When the excitation of the electromagnet MCF for regular rotation is released, the operation frame 5 restores by the return spring 19.

Figure 8:
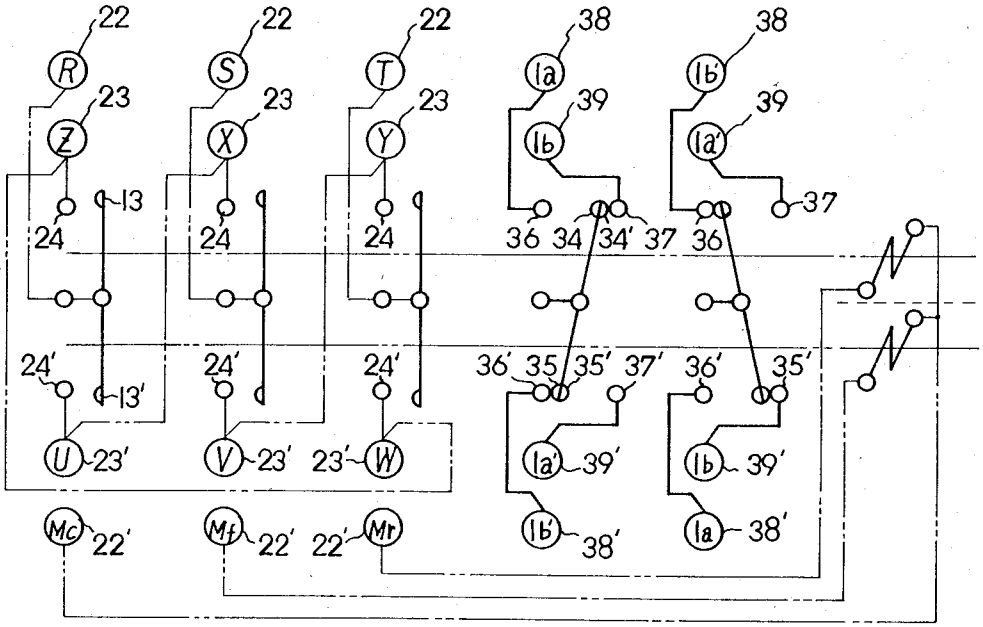
FIG. 8 is a circuit diagram showing the contact construction of the reversible change-over.

Next, when the electromagnet MCR for reversal rotation is excited, the main contact traveling terminal 13 and the main contact stationary terminal 24, namely, the terminals Z, X and Y are connected, and as shown in FIG. 8, R-Z-W, S-X-U and T-Y-V are connected and the circuit for reversal rotation is closed. Simultaneously, the a contact is open and the b contact is closed.

As described in the foregoing, the main contact terminals 22, 22', 23, 23' are used in common for the regular and reversal rotations, and the reversible change-over can be operated.

Figure 9:
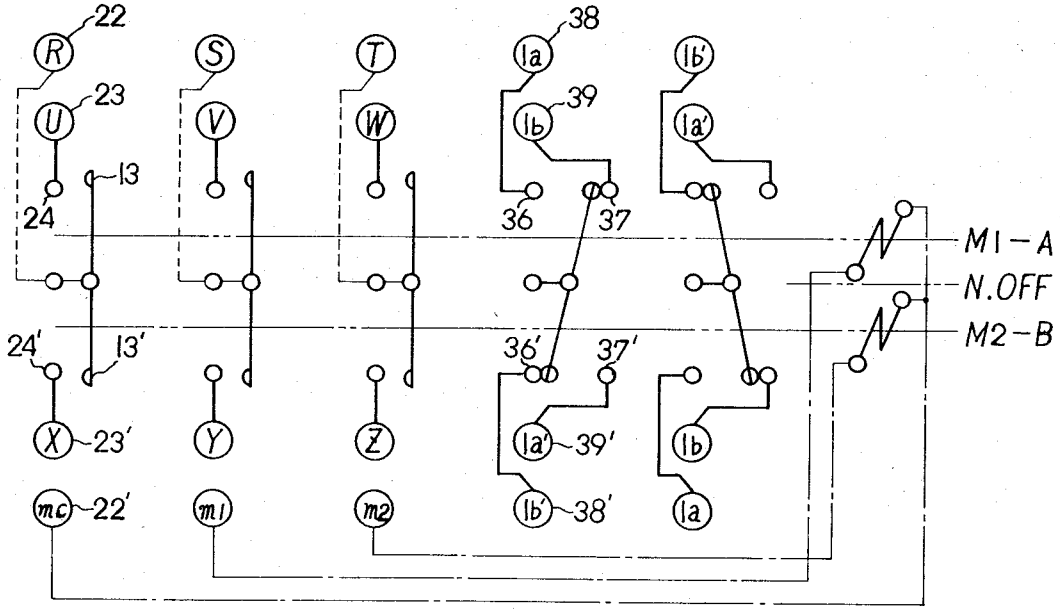
FIG. 9 is a circuit diagram showing the contact construction for change-over.

Furthermore, only the change-over of the wiring of the terminal bar 27, the contact construction can be simply formed as the change-over contactor as shown in the circuit diagram of FIG. 9.

Figure 10:
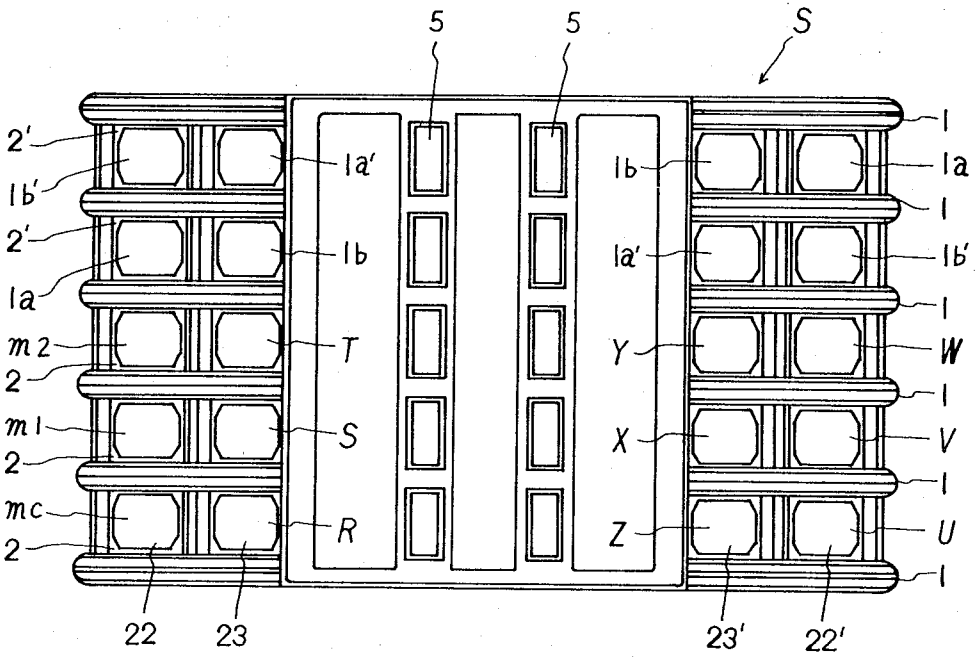
FIG. 10 is a top view showing the reversible change-over contact according to another embodiment of this invention.
Figure 11:
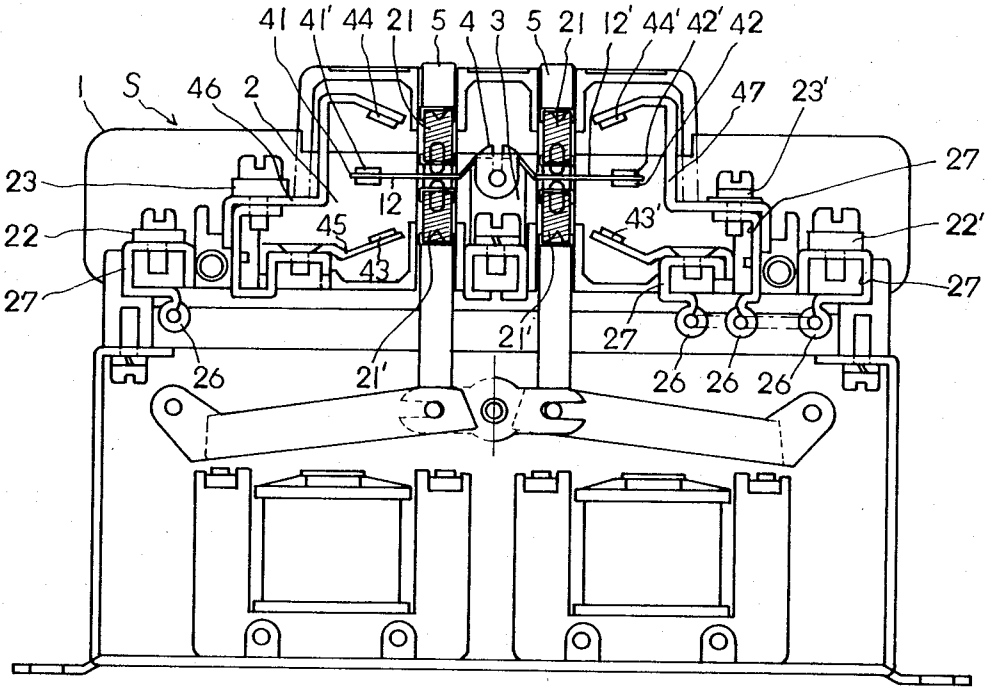
FIG. 11 is a vertical cross section showing the contact construction of the main contact in the OFF condition.
Figure 12:
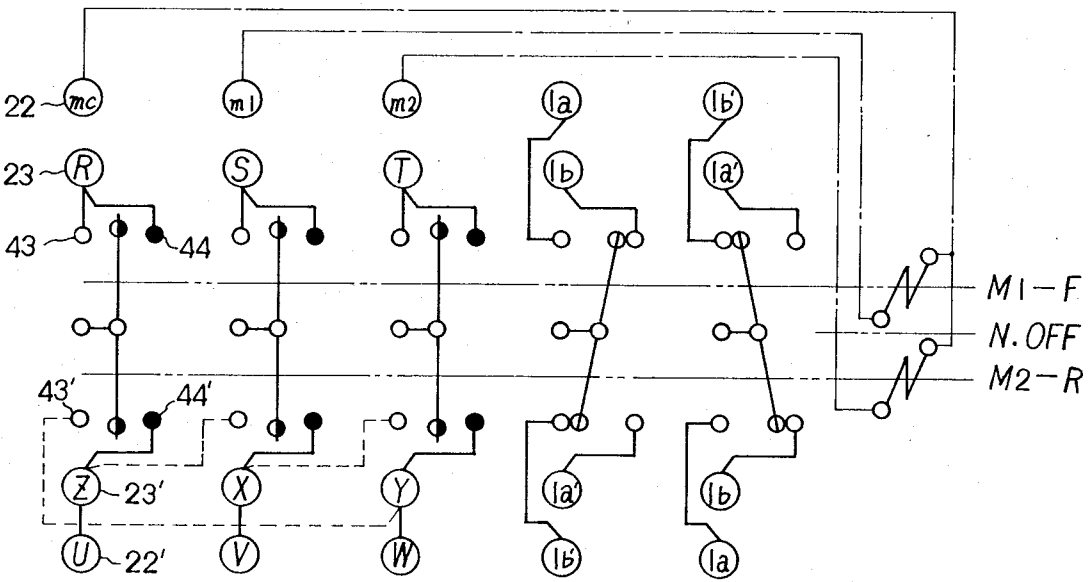
FIG. 12 is a circuit diagram, corresponding to the assembly of FIG. 11.

FIG. 10 through FIG. 12 shown the reversible change-over electromagnetic contactor according to another embodiment of this invention, and in the arrangement of the case S, the traveling contact mechanism and the terminals, it is formed entirely similar to the reversible change-over electromagnetic contactor shown in FIG. 1 through FIG. 7. Namely, the case S is formed by providing serially the pole chambers 2, 2, 2 for main contact and the pole chambers 2' and 2' for auxiliary contact as shown in FIG. 10, and the pole chamber 2 for the main contact is assembled by the support frame 3, the traveling contact bar 4 and the pair of the operation frames 5 as shown in FIG. 11, and the contact bar 4 is horizontally positioned and sandwiched in the OFF condition by a pair of the vertically disposed contact springs 21 and 21', and is swivellably operated according to the lifting motion of the operation frame 5, and the main contact terminals 22, 22', 23, 23' are disposed at the lower stage on the outside and the upper stage on the inside at the right and left of the case S.

However, in this embodiment, the main contact traveling terminals 41, 41', 42 and 42' are provided at 4 locations on the upper surface and the lower surface of the right and left arm portions 12 and 12' of the traveling contact bar 4 of the main contact, and 4 pieces of the main contact stationary terminals 43, 43', 44, 44' corresponding to 4 pieces of the main contact traveling terminals 41, 41', 42, 42' are disposed at locations corresponding to the swiveling operations of the traveling terminals 41, 41', 42, 42' in the upper and lower parts of the right and left of the traveling contact bar 4. The main contact stationary terminals 43 and 44 are connected to the main contact terminal 23 by means of the contact bars 45 and 46, and the main contact stationary terminal 44' is connected to the main contact terminal 23' by means of the contact bar 47, and the main contact stationary terminal 43' and the main contact terminals 22, 22', 23' are provided with the wiring portion 26 projecting from the case S by the terminal bar 27.

As shown in FIG. 10, the terminal 23 is set to be R, S, T and the terminal 22' is set to be U, V, W, and the terminal 23' is set to be Z, X, Y, and, as shown in FIG. 12, the terminals Z and U, X and V, Y and W are connected by means of the wiring portion 26 of the terminal bar 27. The stationary terminal 43'Y is connected to the terminal Y, the stationary terminal 43'Z is connected to the terminal Z, and the stationary terminal 43'X is connected to the terminal X. Also, the auxiliary contact has the contact construction entirely identical with the embodiment shown in FIG. 7 so that the description is hereby omitted.

When the electromagnet MCF at the regular rotation side is excited, the terminal R-Z-U, S-X-V and T-Y-W are connected, and the regular rotation circuit is turned ON, and when the electromagnet MCR at the reversal rotation is excited, the terminals R-Y-W, S-Z-U and T-X-V are connected and the reversal rotation circuit is turned ON.

Figure 13:
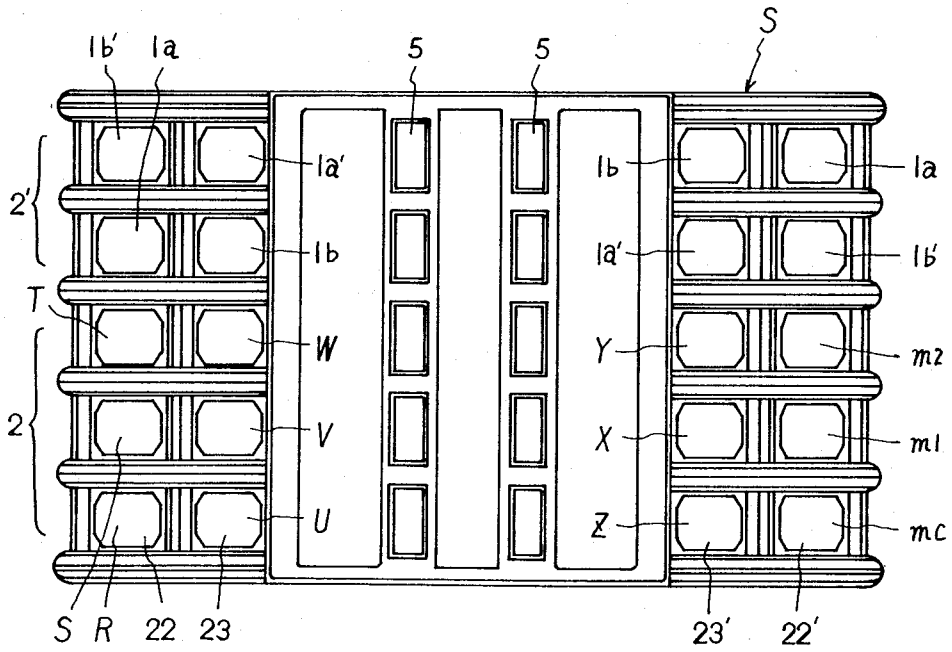
FIG. 13 is a top view showing the Y-Δ contactor according to the another embodiment of this invention.
Figure 14:
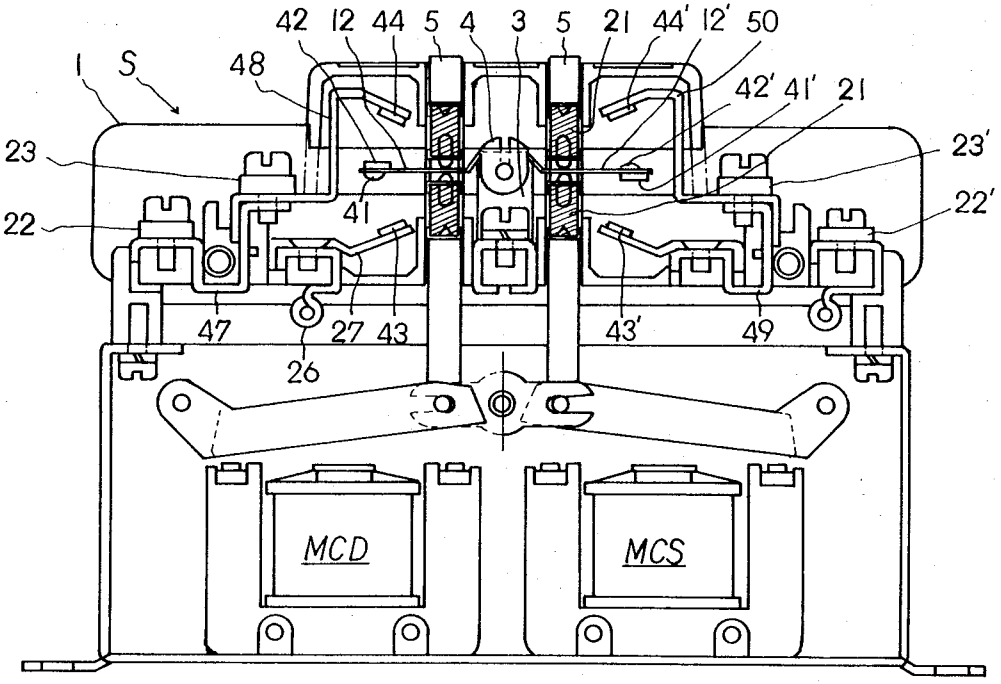
FIG. 14 is a vertical cross section showing the contact construction of the main contact in the OFF condition.
Figure 15:
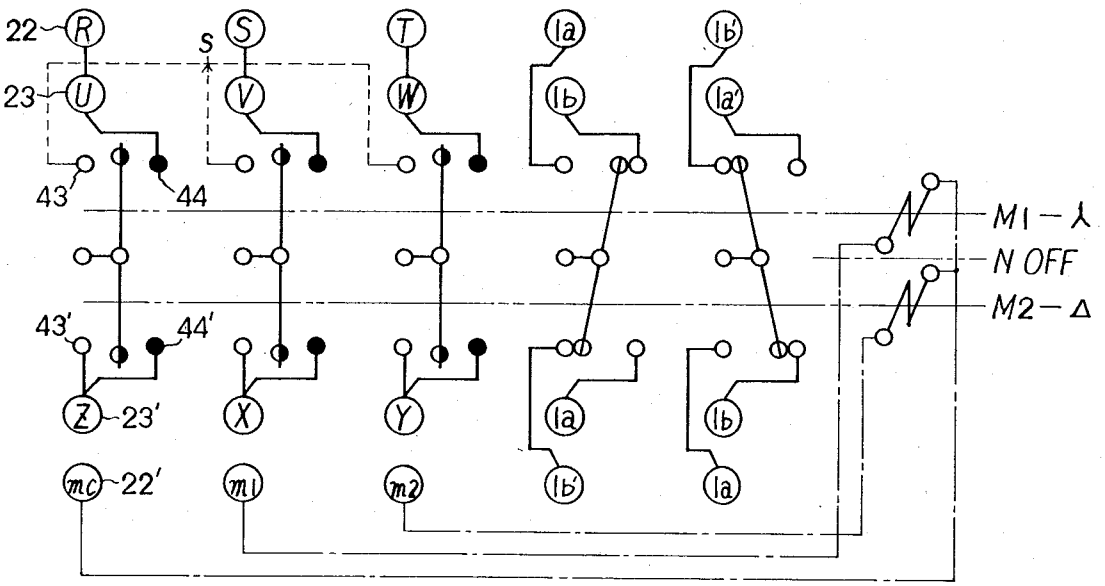
FIG. 15 is the corresponding circuit diagram.

Furthermore, FIG. 13 to FIG. 15 show the Y-Δ electromagnetic contactor according to another embodiment, the contactor is composed of the case S, traveling contact mechanism, main content terminals and 4 pieces of the main contact stationary terminals having the same construction as shown in the embodiment of FIG. 11, and are illustrated by the same symbol.

As shown in FIG. 14, the main contact terminals 22 and 23 are connected by means of the terminal bar 47, and the main contact terminal 23 is connected to the main contact stationary terminal 44 by means of the contact bar 48, and the main contact terminal 23' connects the main contact stationary terminals 43' and 44' by means of the contact bars 49 and 50, and the main contact stationary terminal 43 is wired as the common contact S by means of the terminal portion 26 of the terminal bar 27 as shown with dotted line in the circuit diagram of FIG. 15. The terminal 22 is set to be the terminals, R, S, T, and the terminal 23 is set to be the terminals U, V, W, and the terminal 23' is set to be the terminals Z, X, Y, and when the electromagnet MCS for Y is excited, the terminals R-U-Z, S-V-X and T-W-Y are connected to form the Y circuit, and when the electromagnet MCD for Δ is excited, the Δ circuit is formed by means of the common contact S.

Accordingly, this invention provides a reversible change-over contactor of a Y-Δ contactor which makes possible the multi-purpose contacting of the contact by forming the traveling contact of the metal system, and as a result, the terminals R, S, T, U, V, W and X, Y, Z are used in common for the regular and reversal rotation or for Y and Δ as an integral unit. Therefore, this invention has eliminated the various difficulties such as high cost and the expensive wiring resulting from the provision of two contactors for regular and reversible rotations or two contactors for Y and Δ like in the conventional reversible contactors or Y-Δ change-over contactors. Moreover, this invention can provide a supercompact size contactor, and moreover, the wiring process against the contact construction is made easy as the wiring construction is made on the reverse surface of the case proper by the terminal bar. The 2 contact Y-Δ contactor and 3 contactor system Y-Δ contactors can be easily and optionally manufactured from the change-over contactor and the reversible contactor in the identical structural unit by changing the connection and wiring through the various formations of the contact bars of the stationary contact and the terminal bars which are advantageous features of this invention.

What is claimed is:

1. A connector assembly, comprising (a) a case member provided with a plurality of pole chambers which are serially and vertically sectioned;

(b) a traveling contact member arranged in each of said pole chambers, said traveling contact member including a bar having an arm portion-extending in the left direction, an arm portion extending in the right direction, and at least one traveling contact terminal provided at the tip of each of said left and right arm portions;

(c) a support frame made of conducting material suspended in each of said pole chambers for pivotally fixing said traveling contact members on the top portion thereof;

(d) a pair of right and left operation frames liftably arranged in each of said pole chambers adjacent the right and left arm portions of said traveling contact member, respectively, each of said operation frames being formed with a window through which the adjacent arm portion of said traveling contact member extends and including a pair of upper and lower contact springs arranged in said window for sandwiching said arm portion therebetween and an integral vertical leg portion extending downwardly from one side of its lower surface, said pair of right and left operation frames being interlockingly connected at the lower ends of said leg portions with electromagnetic means, (e) return springs provided on the lower surface of said operation frames and extending downwardly to said electromagnetic means; and (f) stationary contact terminals provided in the path of movement of said traveling contact terminals, at least two connecting terminals provided at one side of said pole chamber, and at least one connecting terminal provided at the other side.

2. A contactor assembly according to the claim 1 in which said pair of upper and lower contact springs are formed to have the same length dimension and the same elastic modulus.

3. A contactor assembly according to the claim 1 in which said pair of upper and lower contact springs are fixed to the upper end and lower ends of the window provided in each of said operation frames, and the respective free ends are guided to vertically expand and contract along the frame portion.

4. A contactor assembly according to the claim 1 in which said stationary contact terminals are provided with a terminal bar having a wiring portion projecting to the lower surface of the case member.

5. A contactor assembly according to the claim 1 in which said pairs of operation frames provided in each pole chamber are formed serially and integrally, and said leg portion is suspended only on the lower surface of the operation frames positioned at each end of said assembly.

6. A contactor assembly according to claim 1 further including a flat plate for covering the mount for said electromagnetic means, a bearing member under said flat plate and a connecting lever pivotally fixed to said bearing member, the leg portions of said pair of operation frames being pivotally fixed to the ends of said connecting lever.

7. A connector assembly comprising (a) a case member provided with a plurality of pole chambers which are serially sectioned by diaphragms;

(b) a traveling contact member arranged in each of said pole chambers, said traveling contact member including a bar having an arm portion extending in the left direction, an arm portion extending in the right direction, and a traveling contact terminal on the lower surface of the tip of each of said left and right arm portions;

(c) a support frame made of conducting material suspended in each of said pole chambers for pivotally fixing said traveling contact member on the top portion thereof;

(d) a pair of right and left operation frames liftably arranged on each of said pole chambers adjacent the right and left arm portions of said traveling contact member, respectively, each of said operation frames being formed with a window through which the adjacent arm portion of said traveling contact member extends and including a pair of upper and lower contact springs arranged in said window for sandwiching said arm portion therebetween and an integral vertical leg portion extending downwardly from one side of its lower surface, said pair of right and left operation frames being interlockingly connected at the lower ends of said leg portions with electromagnetic means, (e) return springs provided on the lower surface of said operation frames and extending downwardly to said electromagnetic means;

(f) a stationary contact terminal arranged at the lower position in the path of movement of each of said right and left traveling contact terminals, respectively; and (g) terminals, R, S, T and terminals, Z, X, Y arranged at one side of the pole chamber and terminals U, V, W arranged at the other side of the pole chamber, the stationary contact terminal of the left side being connected to the terminals Z, X, Y, respectively, and the stationary contact terminal of the right side being connected to the terminals U, V, W, respectively, the terminals R, S, T being connected to the traveling contact of the pole chamber, respectively, and to the terminals Z and W, X and U, V and Y, respectively, a contact construction for reversible change-over is provided.

8. A contactor assembly according to the claim 7 in which the two stationary contact terminals are connected to the terminals Z, X, Y and U, V, W respectively by means of a contact bar, and the terminals R, S, T, Z, X, Y and U, V, W are connected by wiring provided with a terminal bar, said wiring projecting on the lower surface of the case member.

9. A connector assembly, comprising (a) a case member provided with a plurality of pole chambers which are serially sectioned by diaphragms;

(b) a traveling contact member arranged in each of said pole chambers, said traveling contact member including a bar having an arm portion extending in the left direction, an arm portion extending in the right direction, and a traveling contact terminal arranged on the upper and lower surfaces of the tip of each of said left and right arm portions;

(c) a support frame made of conducting material suspended in each of said pole chambers for pivotally fixing said traveling contact member on the top portion thereof;

(d) a pair of right and left operation frames liftably arranged in each of said pole chambers adjacent the right and left arm portions of said traveling contact members respectively, each of said operation frames being formed with a window through which the adjacent arm portion of said traveling contact member extends and including a pair of upper and lower contact springs arranged in said window for sandwiching said arm portion therebetween and an integral vertical leg portion extending downwardly from one side of its lower surface, said pair of right and left cperation frames being interlockingly connected at the lower ends of said leg portions with electromagnetic means, (e) return springs provided on the lower surface of said operation frames and extending downwardly to said electromagnetic means;

(f) a stationary contact terminal arranged in the lower and upper positions, respectively, in the path of movement of each of said right and left traveling contact terminals, respectively, and (g) terminals R, S, T arranged at one side of the pole chamber, and terminals Z, X, Y and terminals U, V, W arranged at the other side, respectively, the stationary contact terminals of the upper portion of the left side and the stationary contact terminals of the lower portion of the left side being connected to the terminals R, S, T, respectively, the stationary contact terminals of the upper portion of the right side being connected to the terminals Z, X, Y, respectively, the stationary contact terminals of the lower portion of the right side being connected to the terminals Y, Z, X, respectively, the terminal Z being connected to the terminal U, the terminal X being connected to the terminal V, and the terminal Y being connected to the terminal W, whereby contact construction for the reversible change-over is provided.

10. A contactor assembly according to the claim 9 in which the stationary contact terminals of the upper portion and the lower portion of the left side are connected to the terminals R, S, T by means of a contact bar, the stationary contact terminals of the upper portion of the right side are connected to the terminals Z, X, Y, and the stationary contact terminals of the right side and the terminals Z, X, Y and U, V, W are connected by means of a terminal bar provided with a wiring portion projecting on the lower surface of the case member.

11. A connector assembly, comprising (a) a case member provided with a plurality of pole chambers which are serially sectioned by diaphragms;

(b) a traveling contact member arranged in each of said pole chambers, said traveling contact member including a bar having an arm portion extending in the left direction, an arm portion extending in the right direction, and a traveling contact terminal arranged on the upper and lower surfaces of the top of each of said left and right arm portions;

(c) a support frame made of conducting material suspended in each of said pole chambers for pivotally fixing said traveling contact member on the top portion thereof;

(d) a pair of right and left operation frames liftably arranged in each of said pole chambers adjacent the right and left arm portions of said traveling contact member, respectively, each of said operation frames being formed with a window through which the adjacent arm portion of said traveling contact member extends and including a pair of upper and lower contact springs arranged in said window for sandwiching said arm portion therebetween and an integral vertical leg portion extending downwardly from one side of its lower surface, said pair of right and left operation frames being interlockingly connected at the lower ends of said leg portions with electromagnetic means, (e) return springs provided on the lower surface of said operation frames and extending downwardly to said electromagnetic means, (f) a stationary contact terminal arranged in the lower and upper positions, respectively, in the path of movement of each of said right and left traveling contact terminals, respectively, and (g) terminals R, S, T and terminals U, V, W arranged at one side of the pole chamber, and terminals Z, X, Y arranged at the other side of the pole chamber, the stationary contact terminals of the upper portion of the left side being connected to the terminals U, V, W, respectively, the terminals at the lower portion of the left side being connected to form a common terminal, each stationary contact terminal of the upper portion and lower portion of the right side being connected to the terminals Z, X, Y, respectively, the terminal R being connected to the terminal U, the terminal S being connected to the terminal V, and the terminal T being connected to the terminal W, whereby a contact construction for Y-Δ is provided.

12. A contactor assembly according to the claim 11 in which the stationary contact terminals of the upper portion of the left side and the stationary contact terminals of the upper portion and lower portion of the right side are connected to the terminals U, V, W, Z, X, Y by means of contact bars, the terminals R, S, T are connected to the terminals U, V, W by means of a terminal bar, and the stationary contact terminals of the lower portion of the left side are connected to wiring by means of said terminal bar, said wiring portion projecting to the lower surface of the case member.

13. A connector assembly, comprising (a) a plurality of pole chambers for main contacts which are serially sectioned by diaphragms, (b) a main contact traveling contact member arranged in each of said main contact pole chambers, said main contact traveling contact member including a bar having an arm portion extending in the left direction and an arm portion extending in the right direction, (c) a support frame made of conducting material vertically suspended in each of said main contact pole chambers for pivotally fixing said main contact traveling contact member on the top portion thereof;

(d) a pair of right and left operation frames liftably arranged in each of said main contact pole chambers adjacent the right and left arm portions of said main contact traveling contact member, respectively, each of said operation frames being formed with a window through which the adjacent arm portion of said main contact traveling contact member extends and including a pair of upper and lower contact springs having the same elastic modulus arranged in said window for sandwiching said arm portion therebetween and an integral vertical leg portion extending downwardly from one side of its lower surface, said pair of right and left operation frames being interlockingly connected at the lower ends of said leg portions with electromagnetic means, (e) return springs provided on the lower surface of said main contact operation frames and extending downwardly to said electromagnetic means;

(f) a plurality of pole chambers for auxiliary contacts which are serially and vertically sectioned and are formed in the pole chambers for the main contacts;

(g) an auxiliary contact traveling contact member arranged in each of said auxiliary contact pole chambers, said auxiliary contact traveling contact member including a bar having an arm portion extending in the left direction and an arm portion extending in the right direction;

(h) a support frame made of conducting material suspended in each of said auxiliary contact pole chambes for pivotally fixing said auxiliary contact member on the top portion thereof;

(i) a pair of right and left operation frames liftably arranged in each of said auxiliary contact pole chambers adjacent the right and left arm portions of said auxiliary contact traveling contact member, respectively, each of said operation frames being formed with a window through which the adjacent arm portion of said auxiliary contact traveling contact member extends and including a pair of short and long contact springs having the same elastic modulus arranged in said window for sandwiching said arm portion therebetween, such that said auxiliary contact traveling contact member is inclined at a predetermined angle when said main contact traveling contact member is at a neutral position, and an integral vertical leg portion extending downwardly from one side of its lower surface, said pair of right and left operation frames being interlockingly connected at the lower ends of said leg portions with electromagnetic means; and (j) return springs provided on the lower surface of said auxiliary contact operation frames and extending downwardly to said electromagnetic means.

* * * * *